US009194640B2

(12) United States Patent
Wirth et al.

(10) Patent No.: US 9,194,640 B2
(45) **Date of Patent: *Nov. 24, 2015**

(54) ONE-PIECE SLEEVE WITH ALTERNATIVE SLOT(S) FOR FIREARM NOISE SUPPRESSOR

(71) Applicant: Tactical Solutions LLC, Boise, ID (US)

(72) Inventors: Michael A. Wirth, Boise, ID (US); Daniel R. Person, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/295,095

(22) Filed: Jun. 3, 2014

(65) Prior Publication Data

US 2015/0001002 A1 Jan. 1, 2015

Related U.S. Application Data

(63) Continuation-in-part of application No. 13/523,452, filed on Jun. 4, 2012, now Pat. No. 8,739,922.

(60) Provisional application No. 61/496,751, filed on Jun. 14, 2011.

(51) Int. Cl.
*F41A 21/30* (2006.01)
*F41A 21/32* (2006.01)
*F41A 21/00* (2006.01)

(52) U.S. Cl.
CPC ..... *F41A 21/30* (2013.01)

(58) Field of Classification Search
CPC ..... F41A 21/30; F41A 21/325
USPC ..... 181/223; 89/14.4, 14.3, 14.2; 42/79
See application file for complete search history.

(56) References Cited

U.S. PATENT DOCUMENTS

| | | | |
|---|---|---|---|
| 959,400 | A | 5/1910 | Stinson |
| 1,111,202 | A | 9/1914 | Westfall |
| 1,341,363 | A | 5/1920 | Fiala |
| 1,342,978 | A | 6/1920 | Young |
| 1,482,805 | A | 2/1924 | Maxim |
| 1,605,864 | A | 11/1926 | Steinegger |
| 1,667,186 | A | 4/1928 | Bluehdorn |
| 2,451,514 | A | 10/1948 | Sieg |
| 3,163,953 | A | 1/1965 | Bridge |
| 3,284,942 | A | 11/1966 | Moseley |
| 3,409,232 | A | 11/1968 | Cholin |
| 3,748,956 | A | 7/1973 | Hubner |
| 3,776,093 | A | 12/1973 | Leverance et al. |
| 4,291,610 | A | 9/1981 | Waiser |
| 4,384,507 | A | 5/1983 | Finn |
| 4,584,924 | A | 4/1986 | Taguchi |
| 4,588,043 | A | 5/1986 | Finn |
| 5,860,242 | A | 1/1999 | O'Neil |
| 7,073,426 | B1 | 7/2006 | White |
| 7,237,467 | B1 | 7/2007 | Melton |
| 7,789,008 | B2 | 9/2010 | Petersen |
| 7,856,914 | B2 | 12/2010 | Shults et al. |
| 8,286,750 | B1 | 10/2012 | Oliver |
| 8,453,789 | B1 * | 6/2013 | Honigmann et al. ..... 181/223 |
| 8,739,922 | B2 | 6/2014 | Wirth et al. |
| 2010/0126334 | A1 | 5/2010 | Shults et al. |

* cited by examiner

*Primary Examiner* — Edgardo San Martin
(74) *Attorney, Agent, or Firm* — Forrest Law Office, P.C.

(57) ABSTRACT

This technology relates to a one-piece sleeve which envelops a chamber with a baffle in a firearm suppressor body. The one-piece sleeve has an elongate opening, or slot, extending longitudinally along all, or part of, the length of the sleeve. The slot may be straight or curved. Also, there may be a plurality of slots. This way, because of the slot(s), the sleeve has increased flexibility and may be easily slightly opened up, and more easily removed from the elongate suppressor body for cleaning.

17 Claims, 7 Drawing Sheets

ONE-PIECE SLEEVE WITH ALTERNATIVE SLOT(S) FOR FIREARM NOISE SUPPRESSOR

This application is a Continuation-in-Part of application Ser. No. 13/523,452, filed Jun. 14, 2012, and issued on Jun. 3, 2014 as U.S. Pat. No. 8,739,922, which claims benefit from U.S. Provisional Application Ser. No. 61/496,751, filed Jun. 14, 2011, the disclosures of both of which are hereby incorporated by this reference.

BACKGROUND OF THE DISCLOSED TECHNOLOGY

1. Field of the Disclosed Technology

This disclosed technology relates generally to firearms, and more specifically relates to a component shroud or shell or sleeve piece for a firearm report or sound suppressor or silencer. The sound suppressor or silencer abates the noise otherwise associated with the firing of the firearm.

2. Related Art

Published Patent Application #2010/0126334 (Schults et al.) discloses a two-piece sleeve which envelops the elongate body and a series of adjacent chambers formed by baffles spaced along the longitudinal axis of a firearm suppressor body. The elongate suppressor body defines a bullet pathway extending longitudinally therethrough. The sleeve is provided in two pieces because this allows for convenient removal of the sleeve parts for cleaning. In use, the gases discharged from firing the firearm are dispersed within the silencer. At the same time, lead and carbon deposits are also dispersed within the silencer, and after repeated firings, result in a build-up therein. For cleaning these built-up deposits, the silencer is removed from the firearm, and disassembled for cleaning. In preparation for this cleaning, it is important that the sleeve be easily removed from around the elongate suppressor body.

Still, there is a need for an easily removable shell or sleeve for a firearm elongate suppressor body which provides for convenient removal for cleaning, but which sleeve is only one piece for ease and economy of manufacture, assembly and cleaning. This disclosed technology addresses that need.

SUMMARY OF THE DISCLOSED TECHNOLOGY

The present disclosed technology is a one-piece shell or sleeve which envelops the elongate body and a series of adjacent chambers formed by a series of body baffles spaced along the longitudinal axis of a firearm suppressor body. The sleeve has an elongate opening, or slot, extending longitudinally, or axially, at least part of the length of the sleeve. In one embodiment, the slot is approximately 1/16" wide for a shell diameter of 1". The slot may extend the entire length of the sleeve. Alternatively, the slot may extend just part of the sleeve length, for example about ¾ or ⅞ or more of the length. Also, the slot may be straight or curved. Also, there may be a plurality, two, three, four or more of partial slots. This way, because of the slot, the sleeve may be more flexible, more easily slightly opened up, and more easily removed from the suppressor body for cleaning.

Also, the elongate suppressor body may have an optional small pin extending radially outwardly from its outer surface. The pin engages in the slot of the one-piece sleeve when the sleeve envelops the suppressor body. This way, the sleeve does not rotate, or spin, relative to the suppressor body, after assembly. Also this way, the sleeve is less likely to shake loose or rattle when the firearm is used.

DETAILED DESCRIPTION OF ONE EMBODIMENT OF THE DISCLOSED TECHNOLOGY

Referring to the Figures, there is shown one, but not the only, embodiment of the subject disclosed one-piece sleeve for firearm noise suppressor.

Figure 1:
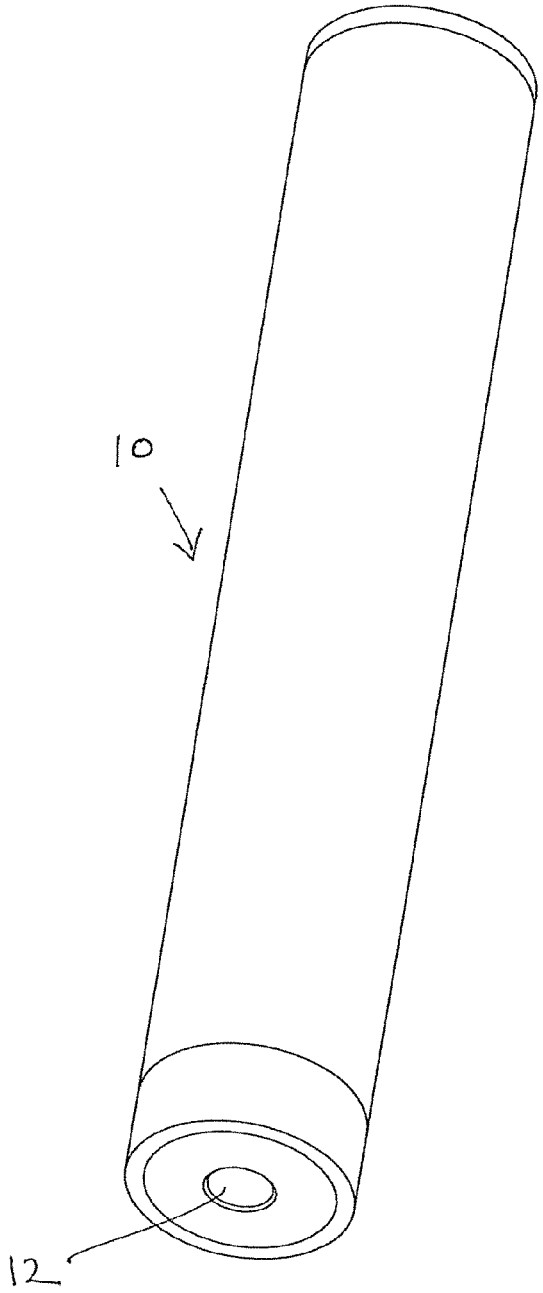
FIG. 1 is a top, perspective front end view of a complete firearm suppressor according to one embodiment of the disclosed technology.

FIG. 1 is a front end perspective view of a complete suppressor 10 for a firearm. FIG. 1 shows the distal end of a suppressor 10 with outlet opening 12. Generally, suppressor 10 is cylindrical. However, other shapes, like hexagonal, for example, are also contemplated for suppressor 10.

Figure 2:
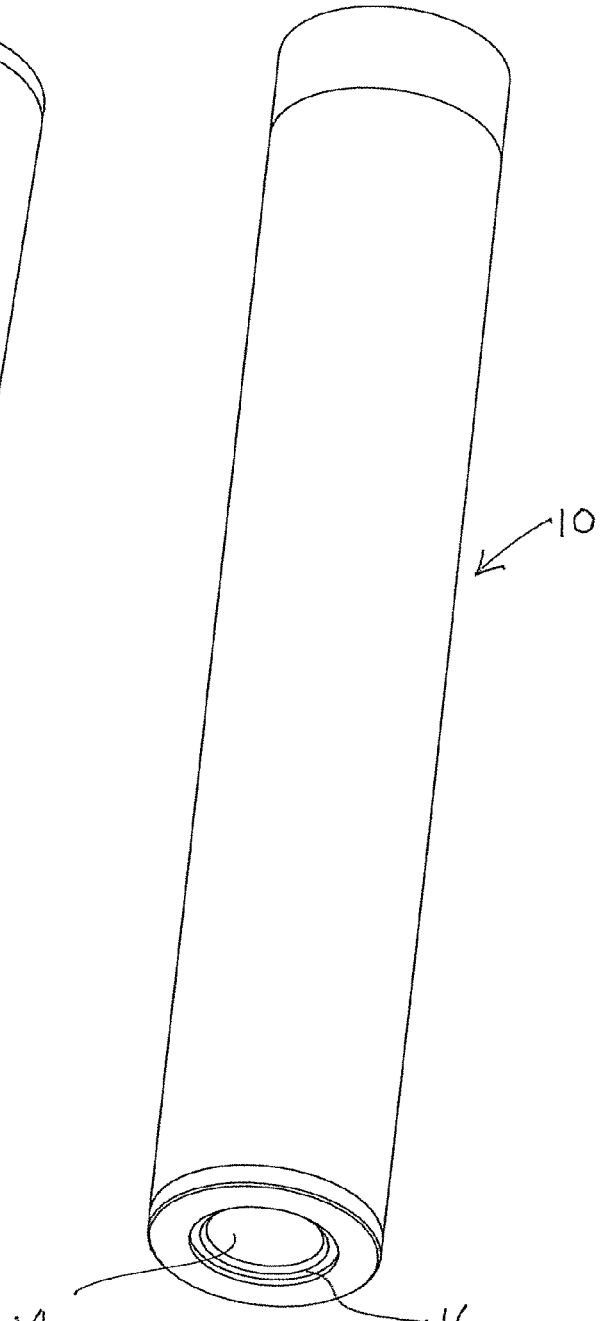
FIG. 2 is a top, perspective back end view of the view depicted in FIG. 1.

FIG. 2 is a back end perspective view of the view depicted in FIG. 1. FIG. 2 shows the proximal end of the suppressor 10 with inlet opening 14 and attachment threads 16 for connecting suppressor 10 to the barrel of a firearm.

Figure 3:
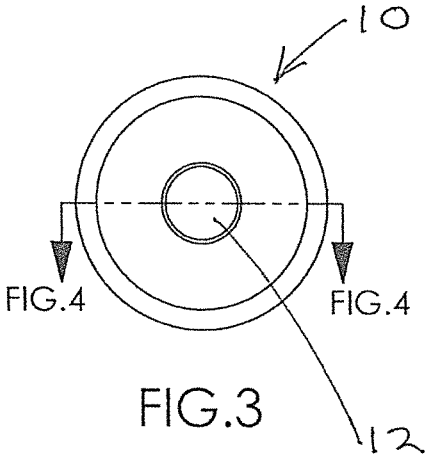
FIG. 3 is a front end view of the embodiment depicted in FIGS. 1 and 2.

FIG. 3 is a front end view of the suppressor 10 depicted in FIGS. 1 and 2 showing outlet opening 12.

Figure 4:
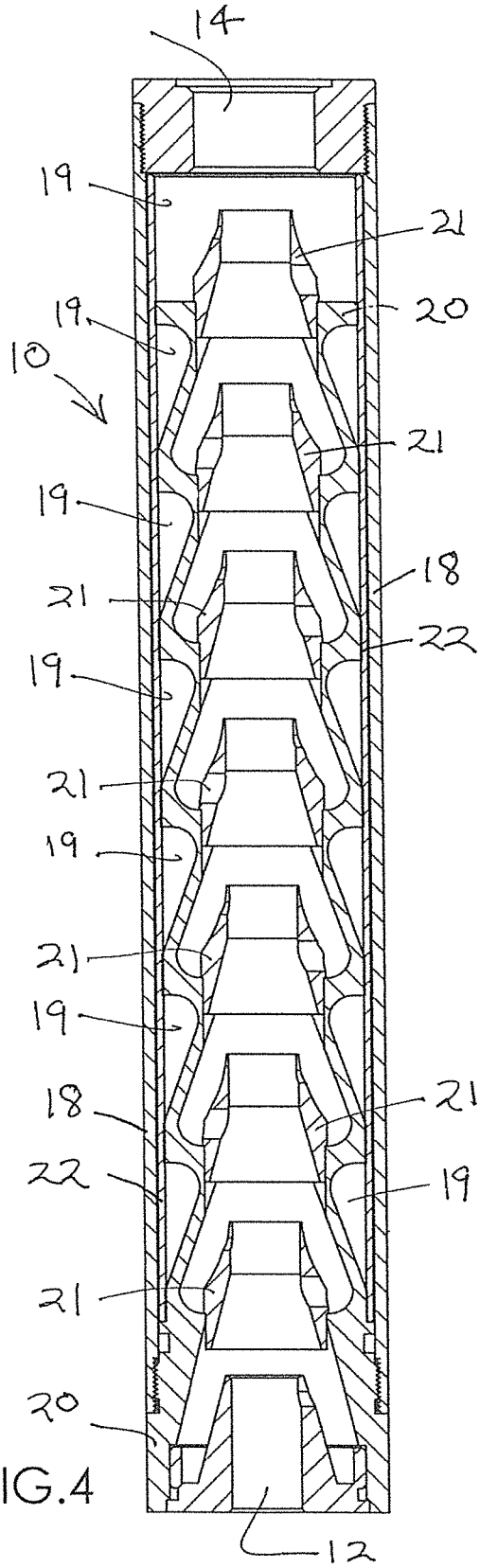
FIG. 4 is a cross-sectional view along the line 4-4 of FIG. 3.
Figure 9:
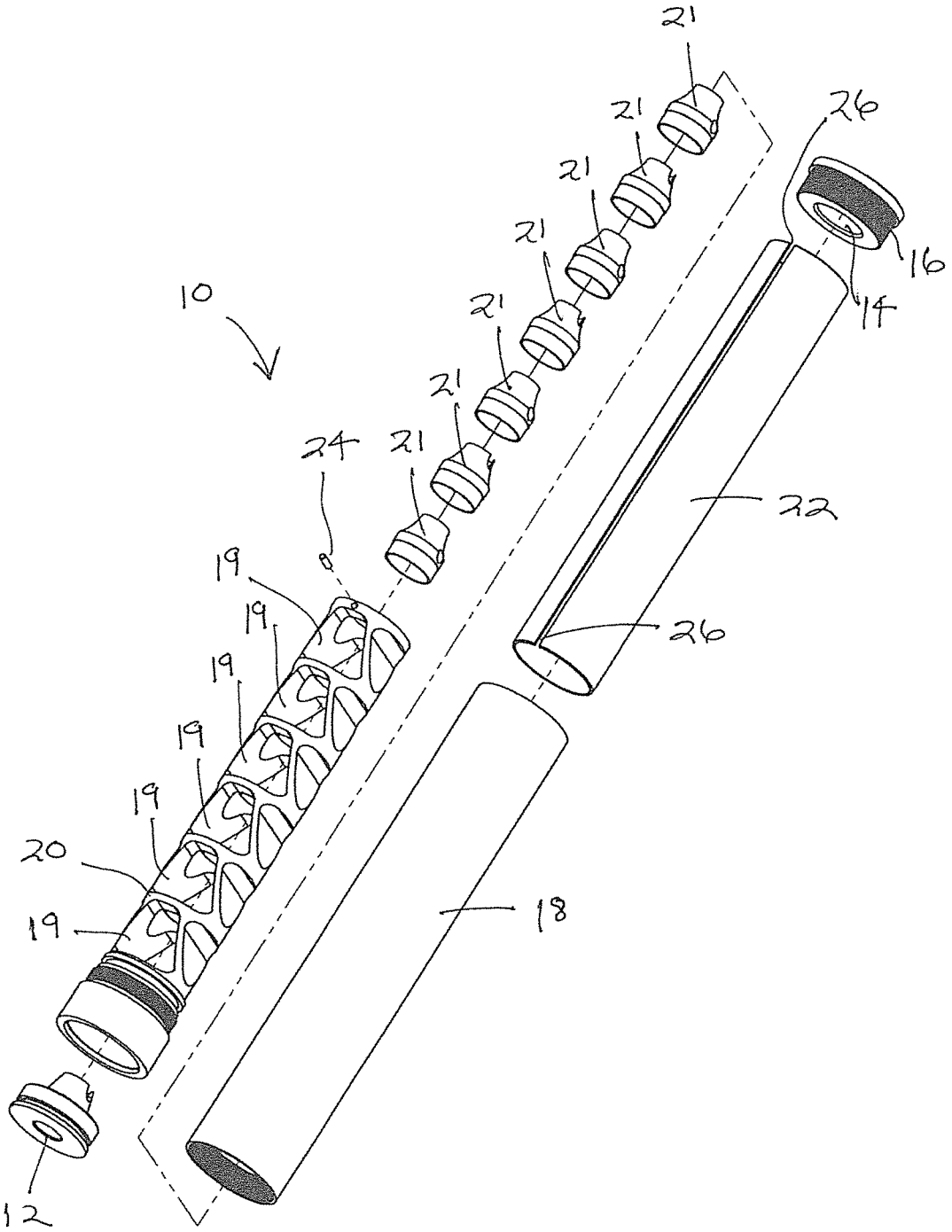
FIG. 9 is a fully exploded view of the embodiment depicted in FIGS. 1-8.
Figure 10:
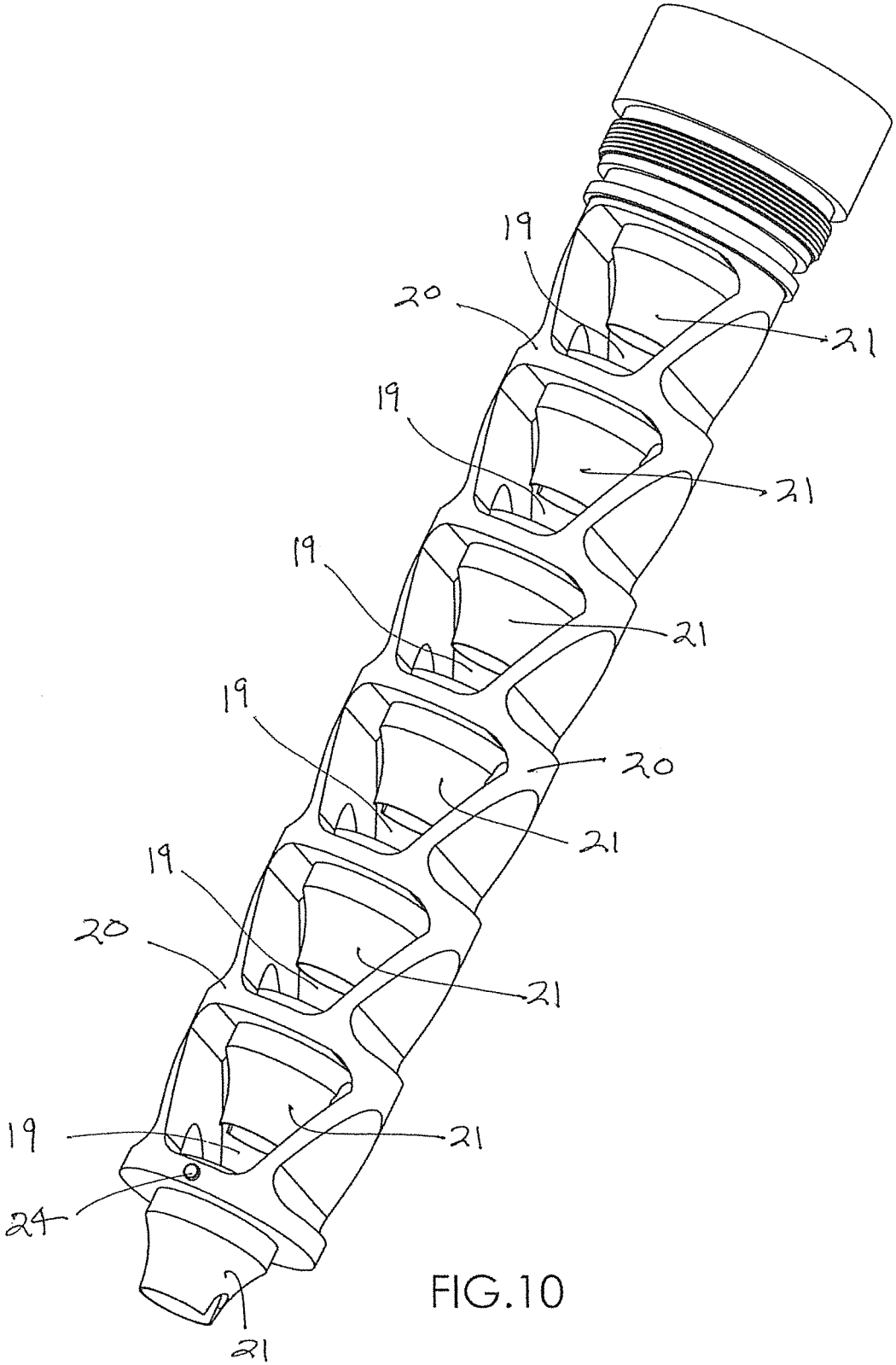
FIG. 10 is an isolated, top perspective view of the elongate suppressor body for the embodiment depicted in FIGS. 1-9.

FIG. 4 is a cross-sectional view of the suppressor 10 showing an outer shell 18 and a series of inner, spaced adjacent chambers 19 inside the elongate body 20 which is inside outer shell 18. Also visible in this FIG. 4 are body baffles 21 within chambers 19 and one-piece sleeve 22 which sleeve 22 is outside elongate body 20, but inside outer shell 18. Elongate body 20 is the outside perimeter for the assembly of a plurality of separate, individual body baffles 21 as shown in FIGS. 9 and 10. Elongate body 20's perimeter is the support about which inner, one-piece sleeve 22 envelops.

However, elongate body 20 and body baffles 21 may exist together in other configurations. For example, elongate body 20 and one or more body baffles 21 may be made together as one complex part. Or, for example, one body baffle 21 may be made with its own integral perimeter support for inner, one-piece sleeve 22. In this latter case, one body baffle 21 may be used also as the elongate body 20. Also, this way, two or more body baffles 21 may be used together, with or without interconnective securement, as the elongate body 20. In this vein, the subject one-piece sleeve 22 is contemplated to envelop any conventional firearm suppressor structure which has a chamber 19 and a baffle 21, even when there is no outer shell 18 present.

Figure 5:
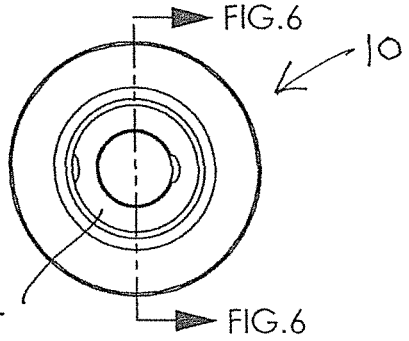
FIG. 5 is a back end view of the embodiment depicted in FIGS. 1-4.

FIG. 5 is a back view of suppressor 10 showing inlet opening 14.

Figure 6:
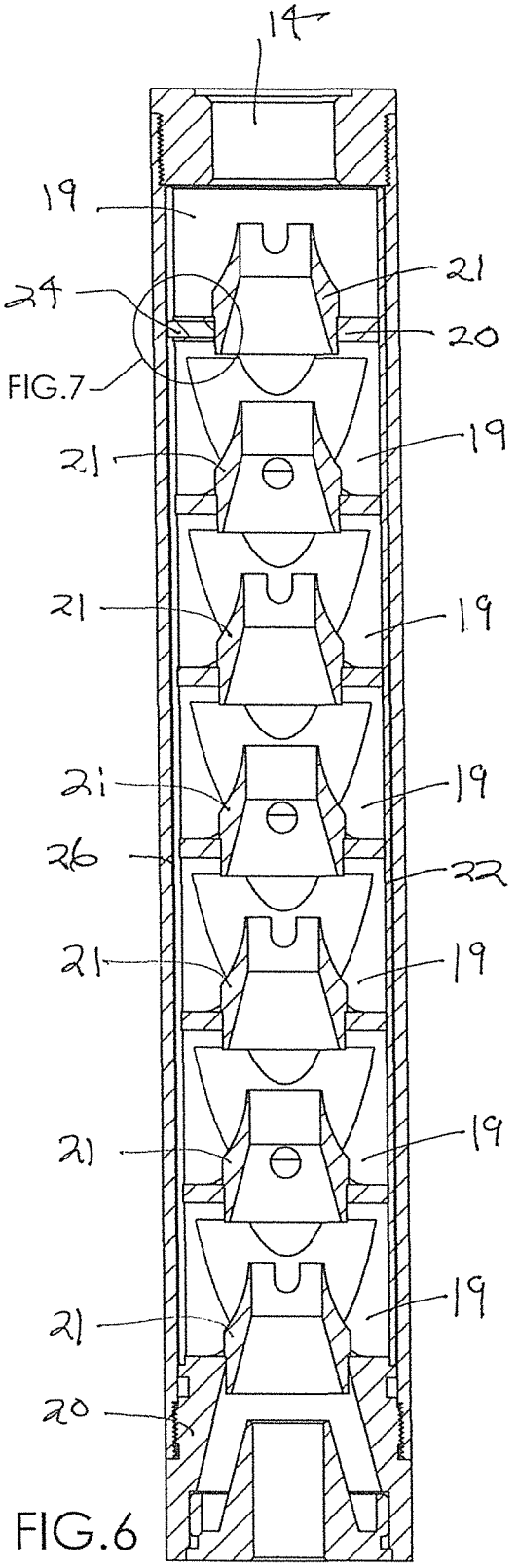
FIG. 6 is a cross-sectional view along the line 6-6 of FIG. 5.

FIG. 6 is a cross-sectional view of suppressor 10 showing inner chambers 19, radially outwardly extending pin 24 from the outer surface of elongate body 20 extending into longitudinal slot 26 of one-piece sleeve 22. Generally, one-piece sleeve 22 is cylindrical. However, other shapes, like hexagonal, for example, are also contemplated for one-piece sleeve 22. Even if suppressor 10 is cylindrical, one-piece sleeve 22 may be hexagonal, for example, and vice-versa.

Outwardly extending pin 24 preferably extends completely through slot 26 and abuts with the inner surface of the outer shell 18.

Figure 7:
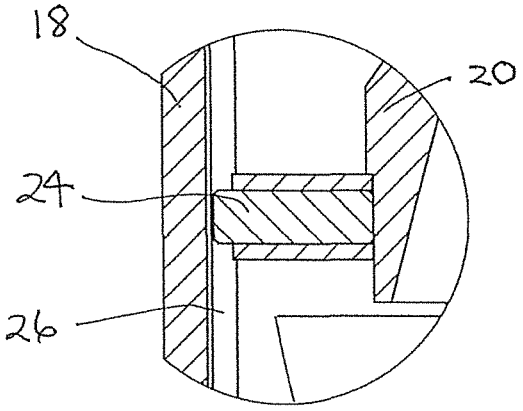
FIG. 7 is a magnified detailed view of the circled area 7 in FIG. 6.

FIG. 7 is a detail view of the area of FIG. 6 wherein pin 24 exists.

Figure 8:
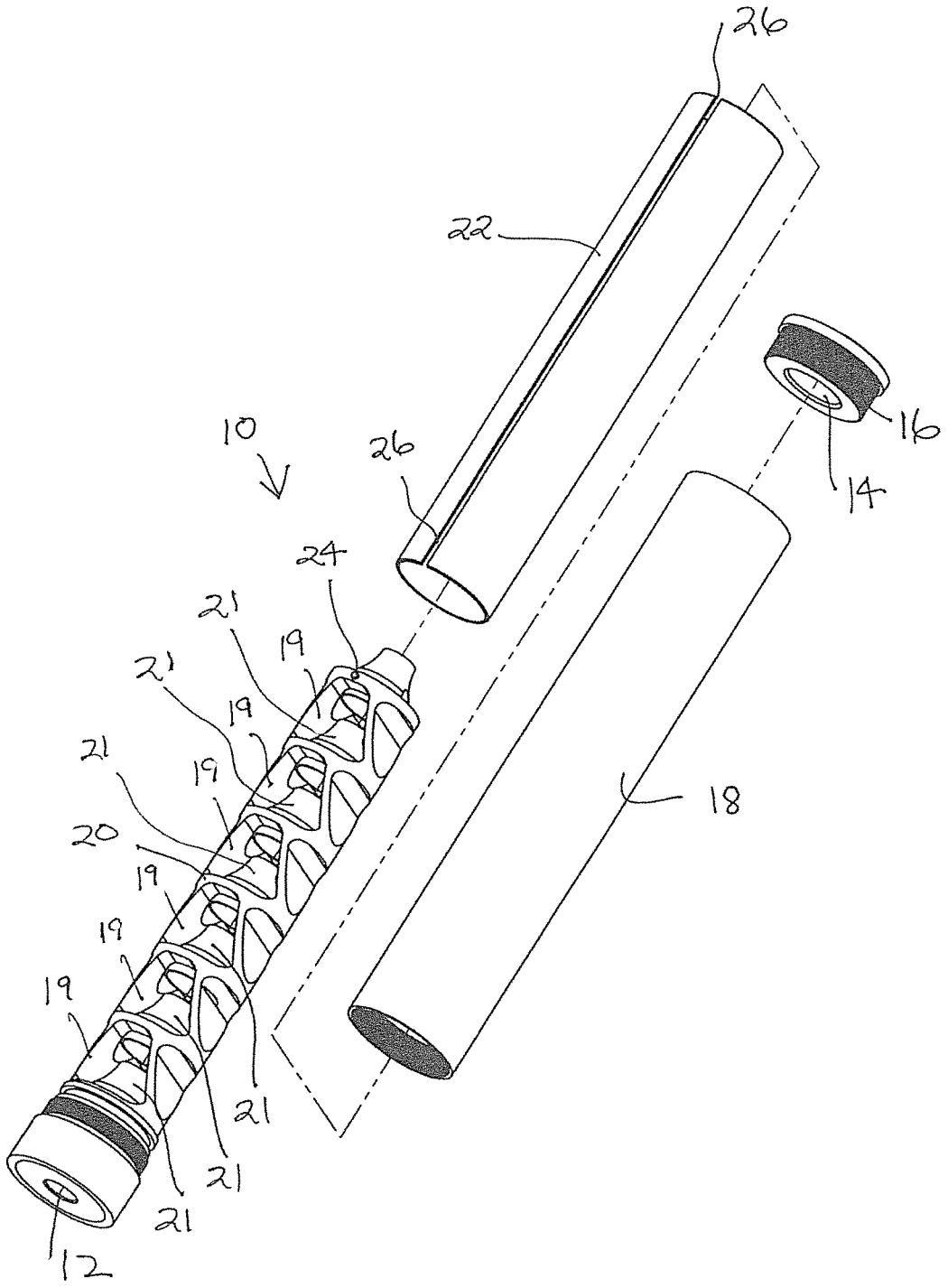
FIG. 8 is a partially exploded view of the embodiment depicted in FIGS. 1-7.

FIG. 8 is a partially exploded view of suppressor 10 showing outlet opening 12, attachment threads 16, outer shell 18, inner chambers 19, elongate body 20 with body baffles 21 and radial pin 24, and one-piece sleeve 22 with longitudinal slot 26. Longitudinal slot 26 may extend for all, or only part, of the longitudinal length of one-piece sleeve 22. For ease of manufacture, slot 26 preferably extends for the entire length of sleeve 22. However, alternative embodiments wherein slot 26 extends for only a portion of the length of sleeve 22 are also contemplated. In addition, other alternative embodiments which comprise a plurality of slots 26, arranged apart radially and/or longitudinally, are also contemplated.

FIG. 9 is a fully exploded view of suppressor 10.

FIG. 10 is an isolated view of the elongate suppressor body 20 with body baffles 21 and radial pin 24.

Figure 11:
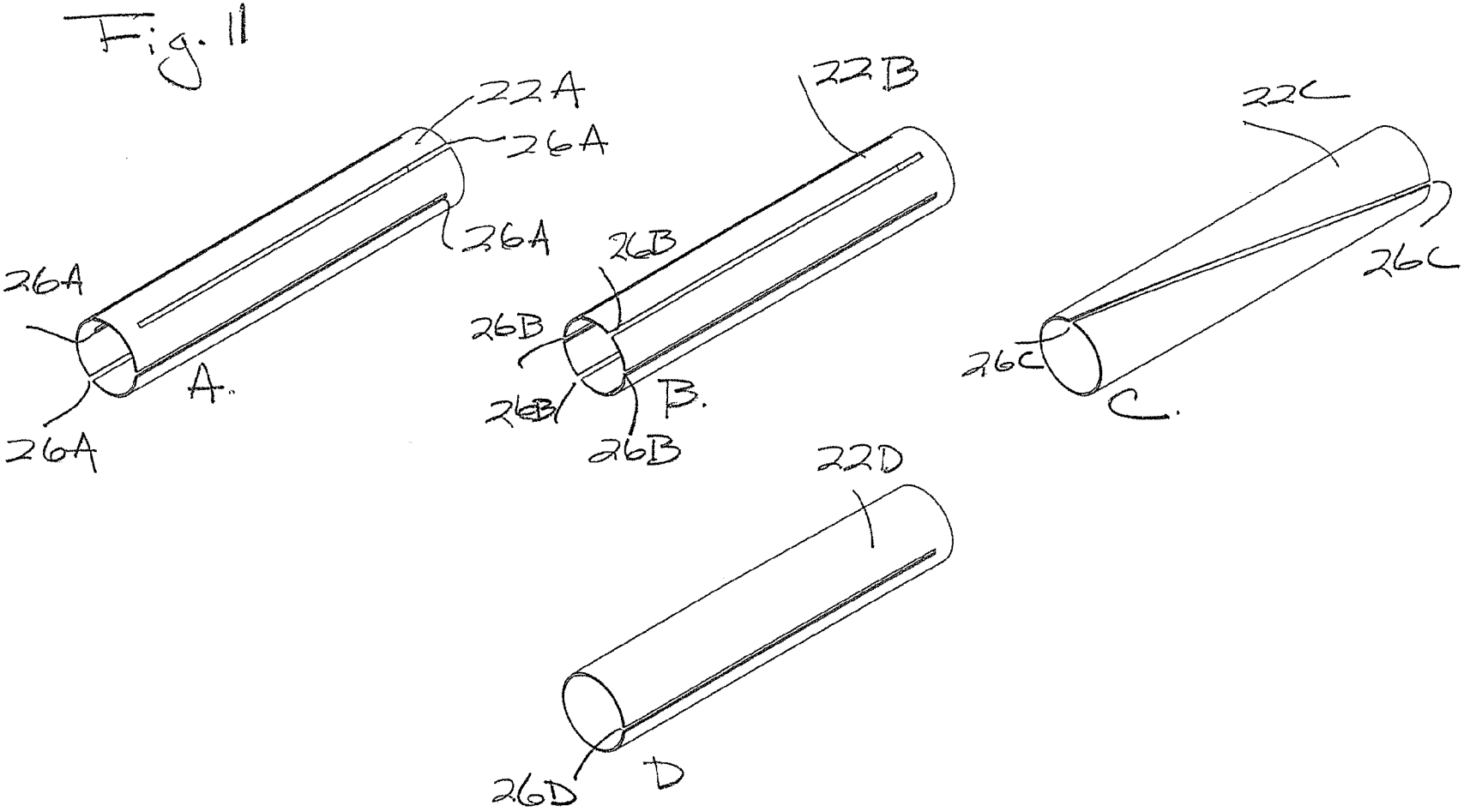
FIG. 11A-D are four top, perspective views of alternative embodiments of the one-piece sleeve depicted in FIGS. 8 and 9.

FIG. 11A-D are four, top perspective views of alternative embodiments of the one-piece sleeve 22 depicted in FIGS. 8 and 9. In FIG. 11A, four, spaced-apart partial slots 26A extend sequentially from first one end, and then the other, of sleeve 22A. In FIG. 11B, four, spaced-apart partial slots 26B extend all from one end of sleeve 22B. In FIG. 11C, one complete, curved (spiral) slot 26C extends from one end to the other end of sleeve 22C. In FIG. 11D, one partial, straight slot 26 extends from one end of sleeve 22D.

Preferably, one-piece sleeve 22 is made from stainless steel, titanium or aluminum or other appropriate material, including tough plastics, and composites of two or more materials, etc. For example, a $1/16^{th}$ inch sheet of stainless steel in the appropriate dimensions may be cut from a larger sheet by stamping. Then, the cut smaller sheet may be rolled in a cylinder until its two end edges are about $1/16^{th}$ inch apart. The slot width may vary slightly from sleeve to sleeve, or to fit different makes and models and styles of elongate suppressor bodies. Then, the cut and rolled smaller sheet, now one-piece sleeve 22, may be slid over and around elongate suppressor body 20.

Alternatively, sleeve 22 is manufactured as above to result in a firm friction fit around body 20. Preferably, sleeve 22 may be cut from, for example, a thin-walled stainless steel pipe or tube of appropriate wall thickness, and to the appropriate length. Then, longitudinal slot 26 may be machined to the appropriate width and length from the cut pipe. Also, multiple slots, including partial ones, straight ones and curved ones, may also be provided. Also, a mixture of these types of slots may be provided. For the elongate body 20 pictured in the drawings, for example, the outer diameter (OD) of the body is about 0.835 inch, and the sleeve 22 inner diameter (ID) is about 0.842 inch. Other OD/ID relative dimensions, etc. may be used for other, different makes and models and styles of elongate suppressor bodies.

During disassembly, a convenient tool, such as a screw driver tip, may be inserted in longitudinal slot 26 and twisted sideways to urge the slot 26 to expand and open up for more convenient removal of the sleeve 22 from elongate body 20.

Although this disclosed technology has been described above with reference to particular means, materials, and embodiments, it is to be understood that the disclosed technology is not limited to these disclosed particulars, but extends instead to all equivalents within the scope of the following claims.

We claim:

1. A firearm noise suppressor, comprising:

an outer shell for attachment to the muzzle of a firearm;

a chamber within said outer shell, the chamber having a baffle;

the chamber and baffle also being within an inner sleeve, the inner sleeve fitting between an outside perimeter of the chamber and the inside perimeter of the outer shell, the inner sleeve being one-piece, and having an axial slot so that the inner sleeve has increased flexibility.

2. The suppressor of claim 1 wherein the outer shell is generally cylindrical.

3. The suppressor of claim 1 wherein the inner sleeve is generally cylindrical.

4. The suppressor of claim 1 wherein both the outer shell and the inner sleeve are cylindrical.

5. The suppressor of claim 1 wherein the outside perimeter of the chamber has a radially outwardly extending pin.

6. The suppressor of claim 5 wherein the outwardly extending pin is adapted to fit within the axial slot of the inner sleeve.

7. The suppressor of claim 6 wherein the pin extends past the axial slot to abut with an inner surface of the outer shell.

8. The suppressor of claim 1 which has a plurality of axial slots.

9. The suppressor of claim 8 wherein the slots are spaced apart radially in the one-piece sleeve.

10. The suppressor of claim 8 wherein the slots are spaced apart axially in the one-piece sleeve.

11. The suppressor of claim 8 wherein the slots are spaced apart radially and axially.

12. The suppressor of claim 1 wherein the axial slot extends the entire length of the sleeve.

13. The suppressor of claim 1 wherein the axial slot extends just part of the length of the sleeve.

14. The suppressor of claim 1 wherein the slot is straight.

15. The suppressor of claim 1 wherein the slot is curved.

16. The suppressor of claim 1 with a mixture of different types of axial slots.

17. A firearm noise suppressor, comprising:

a suppressor structure for attachment to the muzzle of a firearm;

a chamber within said suppressor structure, the chamber having a baffle;

the chamber and baffle being within a hollow sleeve, the sleeve fitting around the outside perimeter of the chamber and baffle, the sleeve being one-piece, and having a slot so that the sleeve has increased flexibility.

* * * * *